United States Patent [19]

Anderson et al.

[11] Patent Number: 4,562,900

[45] Date of Patent: Jan. 7, 1986

[54] LENS SYSTEM FOR ACOUSTIC TRANSDUCER ARRAY

[75] Inventors: Weston A. Anderson, Palo Alto; William G. Turnbull, Cupertino, both of Calif.

[73] Assignee: Varian Associates, Inc., Palo Alto, Calif.

[21] Appl. No.: 684,232

[22] Filed: Dec. 20, 1984

[51] Int. Cl.[4] ..... G10K 11/00

[52] U.S. Cl. ..... 181/176

[58] Field of Search ..... 181/176

[56] References Cited

U.S. PATENT DOCUMENTS

| | | | |
|---|---|---|---|
| 2,423,459 | 7/1947 | Mason | 181/176 X |
| 2,827,620 | 3/1958 | Batchelder . | |
| 2,937,640 | 5/1960 | Bastir . | |
| 3,017,608 | 1/1962 | Toulis . | |
| 3,090,030 | 5/1963 | Schuck . | |
| 3,559,159 | 1/1971 | Harms et al. . | |
| 3,903,990 | 9/1975 | Tannaka | 181/176 |
| 3,913,061 | 10/1975 | Green | 340/5 MP |
| 3,958,559 | 5/1976 | Glenn et al. | 128/2 V |
| 4,003,383 | 1/1977 | Bruck | 128/404 |
| 4,084,582 | 4/1978 | Nigam | 128/2 V |
| 4,211,949 | 7/1980 | Brisken et al. | 310/322 |
| 4,274,421 | 6/1981 | Dory | 128/660 |
| 4,319,490 | 3/1982 | Hartmann, Jr. | 73/642 |
| 4,330,874 | 5/1982 | Sorwick | 367/103 |
| 4,387,599 | 6/1983 | Samodovitz | 73/642 |
| 4,391,281 | 7/1983 | Green | 128/660 |
| 4,441,486 | 4/1984 | Pounds | 128/24 A |
| 4,442,842 | 4/1984 | Baba | 128/660 |
| 4,445,380 | 5/1984 | Kaminski | 73/642 |

*Primary Examiner*—Benjamin R. Fuller

*Attorney, Agent, or Firm*—Stanley Z. Cole; Kenneth L. Warsh

[57] ABSTRACT

A lens system for directing and focussing acoustic energy from an array of acoustic transducers on a small target can be made lightweight, low in absorption and dispersion by incorporating plastic Fresnel lenses with prisms into a monolithic tray of the same plastic with one lens for each transducer.

3 Claims, 2 Drawing Figures

LENS SYSTEM FOR ACOUSTIC TRANSDUCER ARRAY

SUBJECT OF THE INVENTION

The invention pertains to a lightweight lens system for use in a system employing a multiplicity of focussed acoustic transducers.

BACKGROUND OF THE INVENTION

An array of acoustic transducers can be used to direct and focus acoustic energy into a small target in order to heat the target. To accomplish the bending and focussing, prisms and lenses must be used in front of each transducer. Each prism/lens must be precisely positioned relative to the transducers and relative to each other in order to achieve the desired focussing effect. The cumulative weight of the lenses and the framing needed for positioning can be a problem when it is necessary to change the lens array. Thick lenses cause problems of absorption. Highly curved lenses cause problems of scattering.

OBJECTS OF THE INVENTION

An object of the invention is to provide a lightweight prism/lens system for use with an array of acoustic transducer.

Another object of the invention is to make such a prism/lens system as low in absorption and dispersion as possible.

SUMMARY OF THE INVENTION

According to the invention, the system of prisms/-lenses is formed as a one-piece tray of plastic. Plastic is lightweight and by making the array of lenses as a one-piece tray, the maximum strength for minimum weight can be achieved. Each lens segment for an individual acoustic transducer is a Fresnel lens, thereby further reducing the weight and also the absorption of energy by the lens. In the preferred embodiment, in order to reduce the scattering of acoustic energy in the lens, the index of refraction is smaller than the surrounding medium, usually water, and a plano-concave Fresnel lenses with rays as normal to the surfaces as possible are used.

These and further constructional and operational characteristics of the invention will be more evident from the detailed description given hereinafter with reference to the figures of the accompanying drawing which illustrate preferred embodiments and alternatives by way of non-limiting examples.

DETAILED DESCRIPTION OF THE PREFERRED EMBODIMENTS

Figure 1:
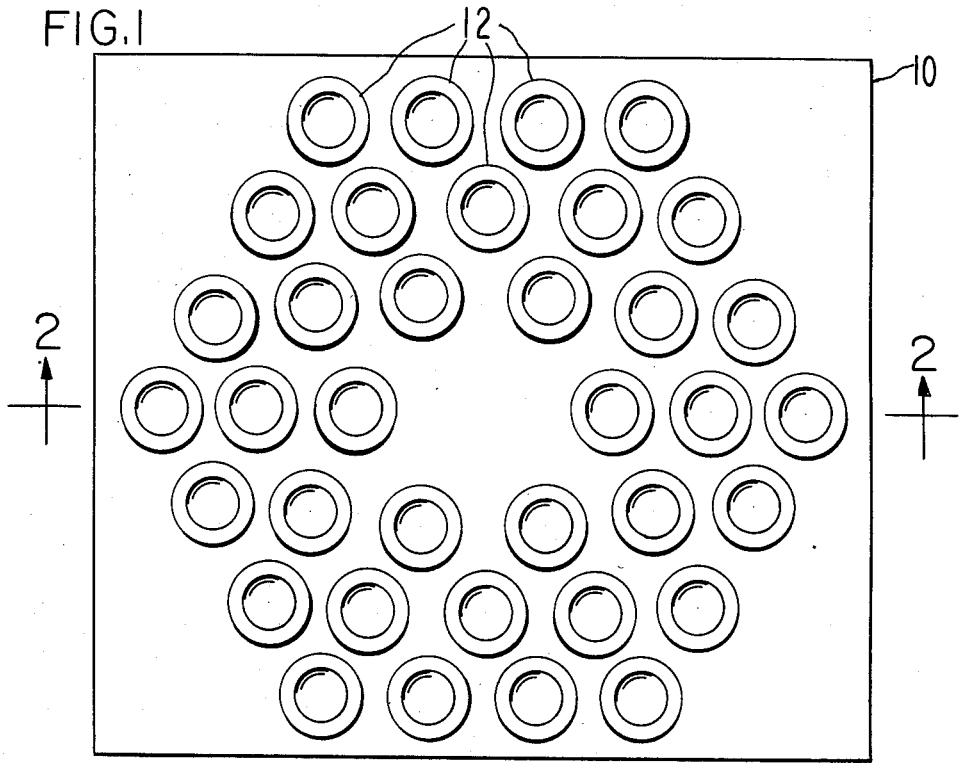
FIG. 1 is a top view of the tray of the invention with an array of Fresnel lenses.
Figure 2:
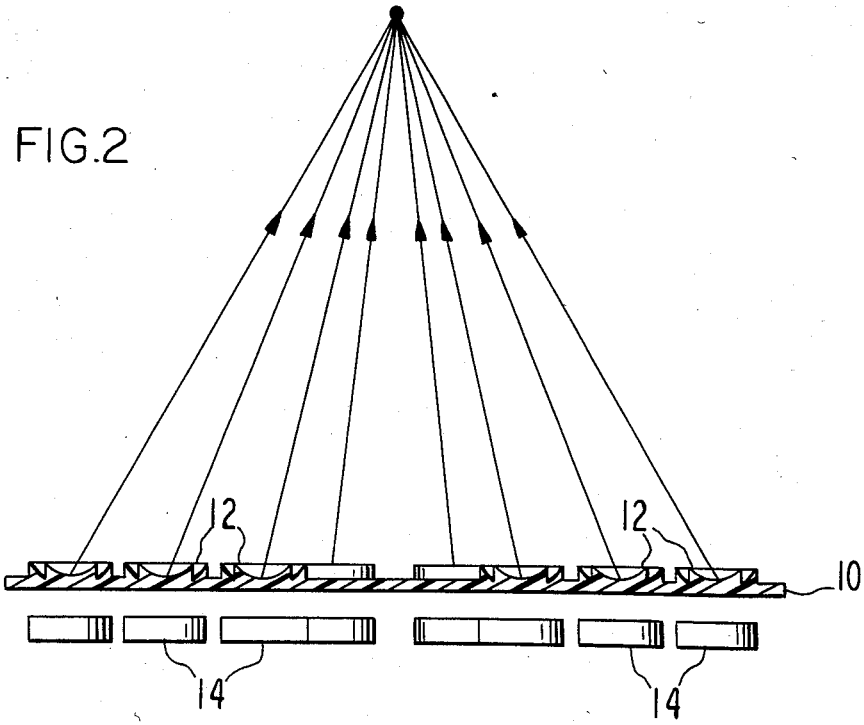
FIG. 2 is a sectional view across the tray of the invention.

Referring now to the drawings wherein reference numerals are used to designate parts throughout the various figures thereof, there is shown in FIG. 1 a top view of the tray 10 of the invention. FIG. 2 is a sectional view of the tray 10. The tray is shown in a general rectangular shape for sliding into a holding frame (not shown) in the acoustic system. Fresnel lenses 12 are located at suitable positions in the tray corresponding to positions above the acoustic transducers 14 when the tray 10 is in place. Each Fresnel lens can have a small prism section to achieve the best aim toward the target. With such prisms, lenses closest to the axis of symmetry have thinner prisms and those furthest from the axis have the thickest prisms. Each lens is positioned over its corresponding transducer such that rays impinge on liquid-plastic interfaces as nearly normal as possible to minimize scattering. Each Fresnel lens preferably has two to six rings in order to achieve the desired focus while minimizing thickness. The thinner the Fresnel lens the less energy absorption in the plastic.

The medium in which the tray is immersed may be any fluid, but water is the most common. The plastic may be chosen to have a speed of sound less than that of the medium, in which case the lenses would be plano-concave in shape.

The advantages of having a lightweight, single piece tray of properly alligned elements are all too clear. Particularly in the usual treatment/diagnostic environment devices which simplify the procedure improve the quality of the treatment delivered to the patient and reduce the cost to the patient.

Further advantages such as reduction of absorption and scattering with the invention improve the efficiency of the apparatus and reduce the undesired side effects to the patent.

The invention is not limited to the preferred embodiments heretofore described, to which variations and improvements may be made, consisting of mechanically and optically equivalent modifications to component parts, without leaving the scope of protection of the present patent, the characteristics of which are summarized in the following claims.

What is claimed is:

1. An acoustic energy delivery system, comprising:

a multiplicity of acoustic transducers;

means for exciting said transducers; and means for directing and focussing acoustic energy from said multiplicity of acoustic transducers onto a target, said means for directing and focussing including a monolithic tray of plastic incorporating a multiplicity of Fresnel lenses and prisms in portions thereof.

2. An acoustic energy delivery system as in claim 1 wherein the acoustic energy is transmitted from said multiplicity of acoustic transducers to the target through a liquid, wherein the plastic of said monolithic tray has speed of sound less than of said liquid, and wherein the portions of said monolithic tray having Fresnel lenses are plano-concave Fresnel lenses.

3. An improvement in the means of focussing acoustic energy from an array of acoustic transducers onto a target through a liquid medium where the improvement in the means for focussing comprises:

a monolithic tray of plastic incorporating a multiplicity of Fresnel lenses and prisms, said plastic having a speed of sound less than that of the liquid medium, there being one said Fresnel lens for each acoustic transducer in the array, each said Fresnel lens being plano-concave in shape and each said Fresnel lens being positioned in said monolithic tray to achieve a focus on the target.

* * * * *